US006398910B1

(12) United States Patent
Burazin et al.

(10) Patent No.: US 6,398,910 B1
(45) Date of Patent: Jun. 4, 2002

(54) DECORATIVE WET MOLDING FABRIC FOR TISSUE MAKING

(75) Inventors: Mark Alan Burazin, Oshkosh, WI (US); Kai F. Chiu, Bellevue, WA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/748,587

(22) Filed: Dec. 22, 2000

Related U.S. Application Data

(60) Provisional application No. 60/173,569, filed on Dec. 29, 1999.

(51) Int. Cl.[7] ..... D21F 7/08

(52) U.S. Cl. ..... 162/109; 162/117; 162/361; 162/362; 162/900; 162/902; 442/1; 442/2; 442/185; 442/320; 139/425 A

(58) Field of Search ..... 162/109, 116, 162/117, 361, 900, 362, 902; 442/1, 2, 185, 320; 139/425 A, 383 A

(56) References Cited

U.S. PATENT DOCUMENTS

| | | | |
|---|---|---|---|
| 2,038,712 | A | 4/1936 | Brodin |
| 3,705,079 | A | 12/1972 | Lee et al. |
| 4,154,883 | A | 5/1979 | Elias |
| 4,212,703 | A | 7/1980 | D'Amico et al. |
| 4,382,987 | A | 5/1983 | Smart |
| 4,440,597 | A | 4/1984 | Wells et al. |
| 4,514,345 | A | 4/1985 | Johnson et al. |
| 4,533,437 | A | 8/1985 | Curran et al. |
| 4,552,620 | A | 11/1985 | Adams |
| 4,556,451 | A | 12/1985 | Ely |
| 4,942,077 | A | 7/1990 | Wendt et al. |
| 5,071,697 | A | 12/1991 | Gulya et al. |
| 5,126,015 | A | 6/1992 | Pounder |
| 5,161,207 | A | 11/1992 | Pikulski |
| 5,230,776 | A | 7/1993 | Andersson et al. |
| 5,314,584 | A | 5/1994 | Grinnell et al. |
| 5,328,565 | A | 7/1994 | Rasch et al. |
| 5,334,289 | A | 8/1994 | Trokhan et al. |
| 5,372,876 | A | 12/1994 | Johnson et al. |
| 5,399,412 | A | 3/1995 | Sudall et al. |
| 5,401,557 | A | 3/1995 | Inomata et al. |
| 5,429,686 | A | 7/1995 | Chiu et al. |
| 5,437,908 | A | 8/1995 | Demura et al. |
| 5,510,002 | A | 4/1996 | Hermans et al. |
| 5,527,429 | A | 6/1996 | Dambreville et al. |

(List continued on next page.)

FOREIGN PATENT DOCUMENTS

| | | |
|---|---|---|
| CA | 809923 | 4/1969 |
| CA | 919467 | 1/1973 |
| EP | 0 677 612 A2 | 4/1995 |
| GB | 1059983 | 2/1967 |
| WO | WO 98/59110 | 12/1998 |

OTHER PUBLICATIONS

International Search Report, PCT Application PCT/US00/35441, May 10, 2001.

*Primary Examiner*—Peter Chin
(74) *Attorney, Agent, or Firm*—Brinks Hofer Gilson & Lione

(57) ABSTRACT

Tissue products such as facial tissue, bath tissue, paper towels and the like are wet molded and dried using a through-air-drying fabric which has a three dimensional, sculptured, textured background accentuated with decorative signature patterns. The textured background is woven into the fabric. The decorative patterns are created by using a smooth polymeric substance or by yarn stitches. The decorative patterns on the through air drying fabric provide enhanced aesthetics, while the textured background provides improved properties such as absorbent capacity, absorbent rate, stretch, flexibility, drape, bulk, and hand feel when used in tissue making.

21 Claims, 5 Drawing Sheets

U.S. PATENT DOCUMENTS 5,565,132 A 10/1996 Salyer
5,591,309 A 1/1997 Rugowski et al.
5,593,545 A 1/1997 Rugowski et al.
5,607,551 A 3/1997 Farrington, Jr. et al.
5,609,725 A * 3/1997 Van Phan ..... 162/117
5,637,106 A 6/1997 Mitchell et al.
5,667,636 A 9/1997 Engel et al.
5,672,248 A 9/1997 Wendt et al.
5,693,187 A 12/1997 Ampulski et al.
5,746,887 A 5/1998 Wendt et al.
5,772,845 A 6/1998 Farrington, Jr. et al.
5,804,036 A 9/1998 Phan et al.
5,814,190 A * 9/1998 Van Phan ..... 162/109
5,820,730 A 10/1998 Phan et al.
5,840,403 A 11/1998 Trokhan et al.
5,874,156 A 2/1999 Schulz
5,885,418 A 3/1999 Anderson et al.
5,888,347 A 3/1999 Engel et al.
6,140,260 A 10/2000 Johnson et al.

* cited by examiner

DECORATIVE WET MOLDING FABRIC FOR TISSUE MAKING

CROSS-REFERENCE TO RELATED APPLICATIONS

This application claims the benefit of U.S. Provisional Application No. 60/173,569, filed Dec. 29, 1999, which application is hereby incorporated herein by reference.

FIELD OF THE INVENTION

The present invention relates to papermaking fabrics and a method for making decorative and high bulk tissue. More particularly, the invention is directed toward patterned papermaking fabrics for visually enhancing, improving the texture, and adding a decorative designer signature to a fibrous web during papermaking, and the method of their use.

BACKGROUND OF THE INVENTION

In the manufacture of paper products, particularly tissue products, it is generally desirable to provide an aesthetically pleasing final product with as much bulk as possible without compromising other product attributes, including softness, flexibility, absorbency, hand feel, and durability. However, most papermaking machines operating today utilize a process known as "wet-pressing". In "wet-pressing" a large amount of water is removed from the newly-formed web of paper by mechanically pressing water out of the web in a pressure nip. A disadvantage of the pressing step is that it densifies the web, thereby decreasing the bulk and absorbency of the sheet. One problem encountered in the past by first wet web pressing and/or then dry embossing is the difficulty in obtaining a tissue basesheet with good functionality, such as absorbency and softness, in combination with a pleasant appearance. This wet-pressing step, while an effective dewatering means, compresses the web and causes a marked reduction in web thickness, thus reducing bulk. In addition, using embossing to apply signature designs to a dry web generally results in a paper product that is gritty to hand feel, stiffer at the pattern edges, and with decreased absorbency.

In the preferred through drying method, the wet web is formed by dewatering the papermaking furnish on a forming media, such as a forming fabric or wire. Then, the wet web is transferred to a permeable through-air-drying fabric around an open drum and non-compressively dried by passing hot air through the web while in intimate contact with the fabric. Throughdrying is a preferred method of drying a web because it avoids the compressive force of the dewatering step used in the conventional wet press method of tissue making. The resulting web optionally may be transferred to a Yankee dryer for creping. Because the web is substantially dry when transferred to the Yankee dryer, the Creped Through Air Dried (CTAD) process does not densify the sheet as much as the wet press process. A particularly preferred web is made using the Uncreped Through Air Dried (UCTAD) process which avoids pressing altogether and produces a substantially uniform density web.

Papermaking fabrics are well known in the art. Examples of papermaking fabrics are shown in Wendt et al. U.S. Pat. No. 5,672,248, Chiu et al. U.S. Pat. No. 5,429,686 and Johnson et al. U.S. Pat. No. 4,514,345, which are hereby incorporated by reference. The prior art through-air-drying (TAD) fabrics are woven and further include weaving a strand into the woven fabric to add a different plane or dimension to the TAD fabric. As an example, the Chiu patent basically describes a woven or mesh fabric which may have additionally woven into it a strand, or a plurality of strands, which lays in a different plane or dimension than the woven or mesh fabric into which it is woven. Further, Chiu discloses a sculptured top-face of the through-air-drying fabric which contacts the tissue sheet. A bottom face of the throughdrying fabric confronts the throughdryer. The sheet, when through air dried in intimate contact with the base fabric and sculpture layer, forms a pleasing, three dimensional uniform background texture in the resulting tissue. However, the uniform textured background lacks any distinct decorative signature.

As in Johnson, other fabrics may begin with a conventional non-sculptured woven or mesh fabric as a base over which a stencil may be laid and a polymer spread to fill the openings in the stencil. Essentially, the polymer is allowed to cure and excess polymer is washed from the area over the stencil. These fabrics are costly to produce and are wasteful due to the excess polymer that must be applied and washed off. In addition, the tissue formed lacks the textured background and its associated attributes. The present invention overcomes these limitations and others in the prior art.

BRIEF SUMMARY OF THE INVENTION

It has now been discovered that certain TAD fabrics can impart significantly increased bulk, increased flexibility, visual aesthetics and a high absorbent capacity to the resulting paper product. The height, orientation, and arrangement of the resulting protrusions in the sheet due to the use of a three-dimensional through-air-drying fabric with a decorative pattern thereon provides increased bulk, flexibility, and visual aesthetics and absorbent capacity. All of these properties are desirable for products such as facial tissue, wet-wipes, bath tissue and paper towels or related personal care products, herein collectively referred to as tissue products. The tissue sheets made in accordance with this invention can be used for one-ply or multiple-ply tissue products.

The patterned fabric may be formed in a number of ways. In one aspect of an embodiment, a three-dimensional throughdrying fabric is used to mold a tissue sheet into a three dimensional pattern or shape. A polymeric strand is adhered onto the top face of a three-dimensional sculptured throughdrying fabric, resulting in a thread-like decorative pattern such that the uniform background texture of the top face is apparent where the decorative pattern formed by the polymeric strand is absent.

In an embodiment of the invention, the polymeric strand applied to the TAD fabric is co-planar with the three-dimensional top face.

In a further embodiment, the polymeric strand applied to the TAD fabric is raised in comparison the three-dimensional top face.

In yet a second aspect of the invention, the invention relates to a through-air-drying fabric for wet molding a tissue sheet into a three-dimensional pattern or shape by contacting a tissue sheet with a three-dimensional sculptured first face of a TAD fabric. A polymeric yarn is stitched into the three-dimensional TAD fabric forming a pattern such that the textured first surface is apparent where the pattern formed by the polymeric yarn is absent.

In another aspect of an embodiment, the polymeric yarn stitched into the TAD fabric is co-planar with the three-dimensional top face.

In another embodiment, the polymeric yarn stitched into the TAD fabric is raised in comparison with the three-dimensional top face.

One advantage of the present invention is the addition of visual aesthetics to a tissue product made with a TAD fabric without subsequent dry embossing.

In some embodiments, a further advantage of the invention is to provide a method for adding bulk and visual aesthetics to a tissue product by using a three-dimensional TAD fabric without having to change any other machine clothing, equipment, or critical process values.

The invention will be better understood in light of the attached drawings and detailed description of the invention.

DETAILED DESCRIPTION OF THE DRAWINGS AND PREFERRED EMBODIMENTS OF THE INVENTION

Figure 1:
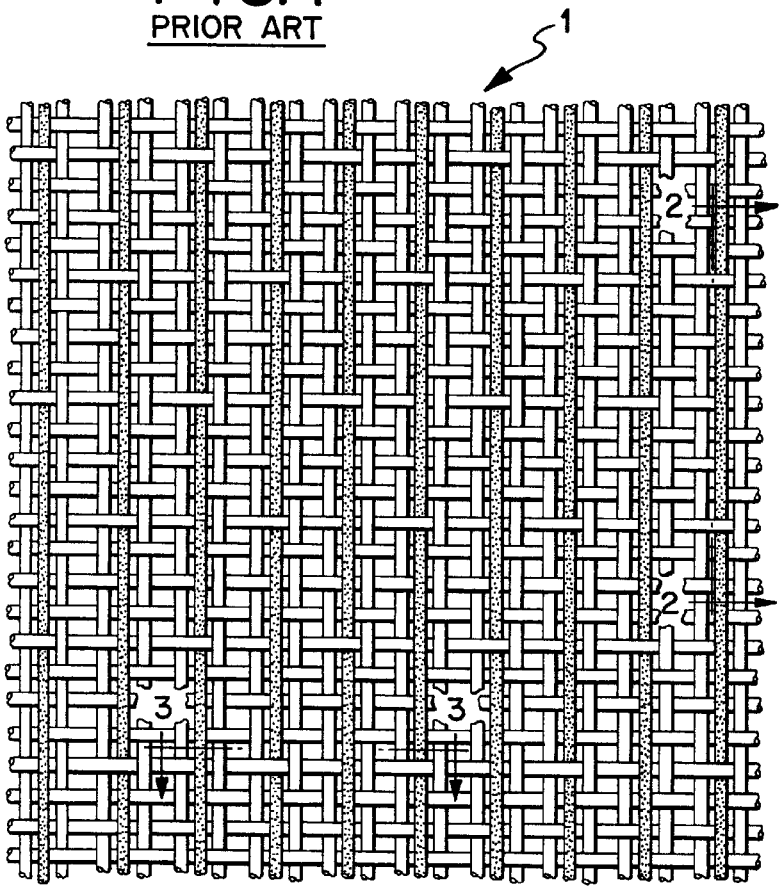
FIG. 1 PRIOR ART
FIG. 1 is a planar view of a prior art through-air-drying fabric.
Figure 2:
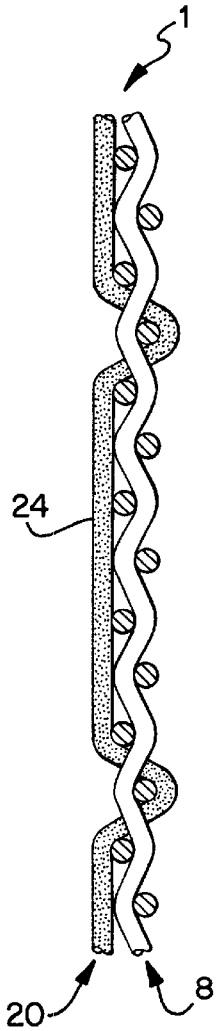
FIG. 2 PRIOR ART
FIG. 2 is a cross-sectional view taken along line 2—2 of the prior art through-air-drying fabric of FIG. 1.
Figure 3:
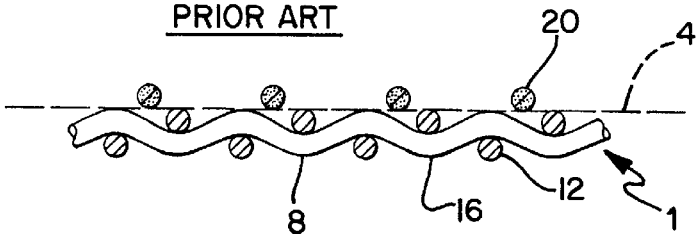
FIG. 3 PRIOR ART
FIG. 3 is a cross-sectional view taken along line 3—3 of the prior art through-air-drying fabric of FIG. 1.

FIGS. 1, 2, and 3 illustrate a prior art through-air-drying fabric 1 in which high impression knuckles are obtained by adding an extra warp system onto a simple 1×1 base design. The extra warp system can be "embroidered" onto any base fabric structure. The base structure becomes the load-bearing layer and at the sublevel plane it serves to delimit the sculpture layer. The simplest form of the base fabric would be a plain 1×1 weave. Of course, other single, double, triple or multi-layer structures can also be used as the base.

Below a sublevel plane indicated by the broken line 4, the fabric 1 comprises a load-bearing layer 8 which consists of a plain-woven fabric structure having base warp yarns 12 interwoven with shute yarns 16 in a 1×1 plain weave. Above the sublevel plane 4, a sculpture layer 20 is formed by impression strand segments 24 which are embroidered into the plain weave of the load-bearing layer 8. In the present instance, each impression segment 24 is formed from a single warp in an extra warp system, which is manipulated so as to be embroidered into the load-bearing layer. The knuckles 28 provided by each warp yarn of the extra warp system are aligned in the machine direction in a close sequence, and the warp yarns of the system are spaced apart across the width of the fabric 1 as shown in FIG. 1. The extra warp system produces a topographical three-dimensional sculpture layer consisting essentially of machine-direction knuckles and the top surface of the load-bearing layer at the sublevel plane 4. In this three dimensional fabric structure, the intermediate plane, which is defined as any additional plane level from by the woven CD knuckles between the top surface and the sublevel plane, is coincident with the sublevel plane. In other more complicated three dimensional fabric structures, intermediate planes may also be present making the structure more interesting.

In one embodiment, a patterned tissue product is formed by the UCTAD method of: (a) depositing an aqueous suspension of papermaking fibers (furnish) onto an endless forming fabric to form a wet web; (b) dewatering or drying the web; (c) transferring the web to a transfer fabric; (d) transferring the web to a TAD fabric of the present invention having a pattern thereon; (e) deflecting the web wherein the web is macroscopically rearranged to substantially conform the web to the textured background and the decorative pattern of the TAD fabric of the present invention; and (f) through-air-drying the web by vacuuming air through the web.

Figure 4:
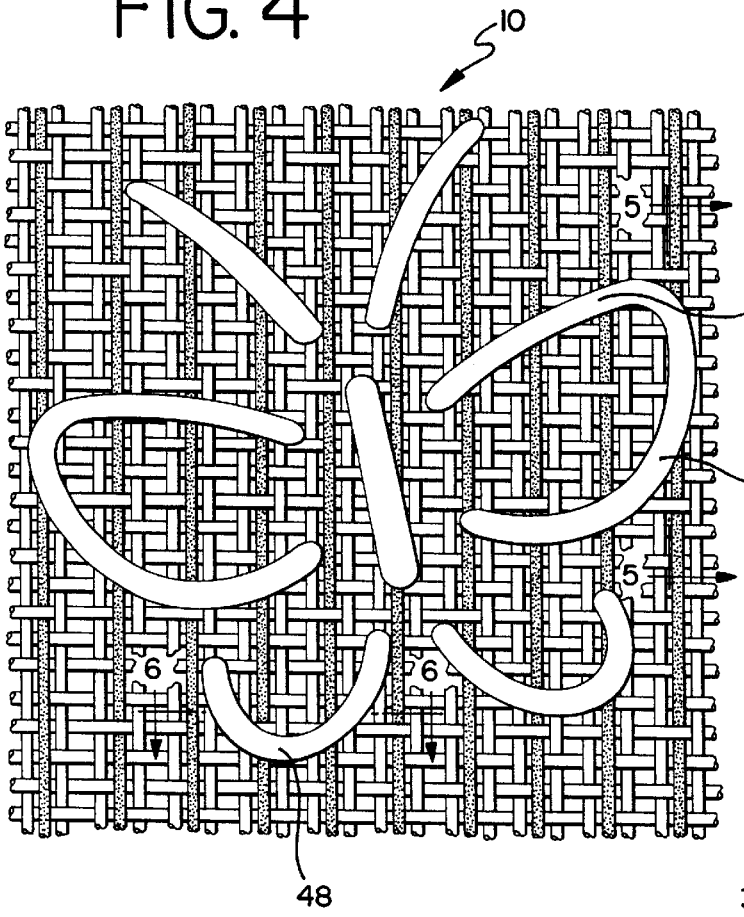
FIG. 4 is a planar view of a first embodiment of the patterned through-air-drying fabric of the invention.
Figure 5:
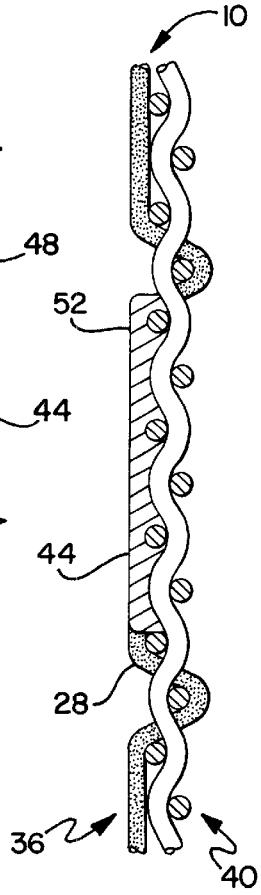
FIG. 5 is a cross-sectional view taken along line 5—5 of the through-air-drying fabric of the invention of FIG. 4.
Figure 6:
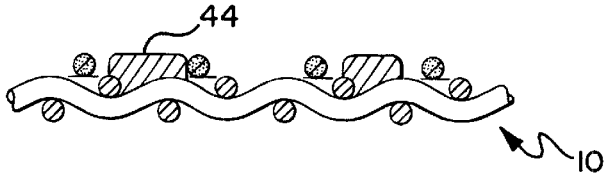
FIG. 6 is a cross-sectional view taken along line 6—6 of the through-air-drying fabric of the invention of FIG. 4.

In another embodiment of the invention, shown in FIGS. 4–6, a woven through-air-drying fabric 10 having a textured surface for imparting a texture on a tissue sheet (not shown) may be used. The TAD fabric 10 has a first surface 36 and a second surface 40. The first surface 36 of the through-air-drying fabric 10 comes into contact with the newly formed tissue sheet and a second surface 40 is located opposite the first surface 36 of the through-air-drying fabric 10. A polymeric strand 44 is adhered onto the first surface 36 of the textured through-air-drying fabric 10. In one embodiment, the polymeric strand 44 may be adhered to the first surface 36 by an extruder or other like applicator. The polymeric strand 44 is adhered to the first surface 36 of the through-air-drying fabric 10 in such a manner as to form a thread-like pattern 48 on said first surface 36 of the through-air-drying sheet 10. In this manner, the textured surface of the TAD fabric 10 is apparent where the pattern 48 area formed by the polymeric strand 44 is absent.

In another embodiment, a polymeric strand 44 is extruded and/or adhered onto the textured surface of the through-air-drying fabric 10 so as to form a thread-like pattern 48. The polymeric strand may have a circular or other cross-sectional shape. Superfluous polymeric material is removed from the first surface 36 of the fabric 10 so that the polymeric strand 44 and top of the yarns making up the texture 28 of the fabric 10 are co-planar. The polymeric material may be removed by any manner known in the art including but not limited to sanding, scraping, cutting, sawing, and/or peeling. In this manner, the top 52 of the polymeric strand 44 is co-planar with the top of the knuckled or textured surface 28. Further, the action of scraping or removing some of the polymeric strand so as to provide a polymeric strand 44 which is co-planar with the knuckled or texture 28 already present in the through-air-drying fabric 10 thereby flattens one side of the polymeric strand 44. The polymeric 44 that is not removed from the surface 36 of the fabric 10 forms a thread-like pattern 48 on the fabric 10. The thread-like pattern 48 appears on the resulting tissue product as the absence of the texture.

Figure 7:
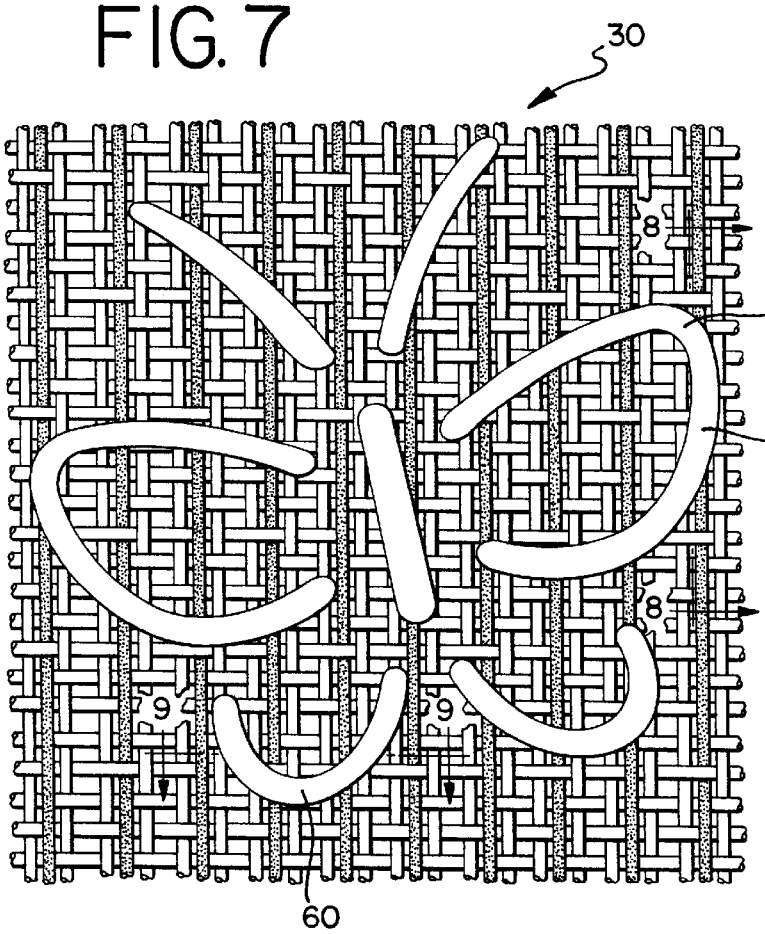
FIG. 7 is a planar view of a second embodiment of the through-air-drying fabric of the invention.
Figure 8:
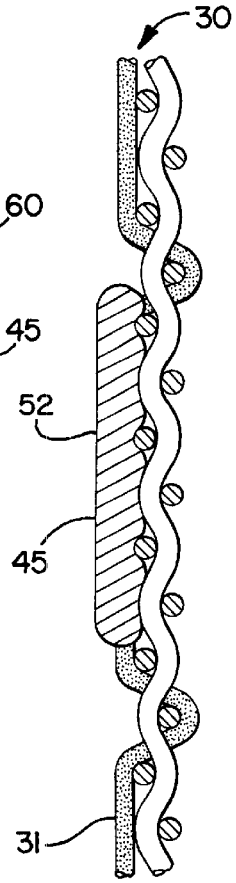
FIG. 8 is a cross-sectional taken view along line 8—8 of the through-air-drying fabric of the invention of FIG. 7.
Figure 9:
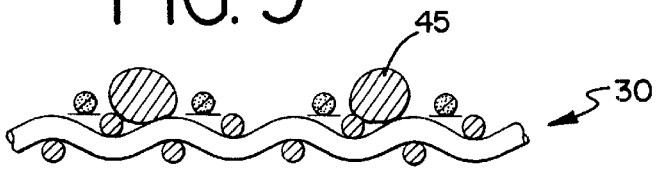
FIG. 9 is a cross-sectional view taken along line 9—9 of the through-air-drying fabric of the invention of FIG. 7.

In another embodiment, shown in FIGS. 7–9, a polymeric strand 45 is extruded onto a TAD fabric 30 having a top surface texture 31. The polymeric strand 45 is applied so as to form a raised pattern 60 above the plane of the texture 31. This pattern results in a raised pattern on the tissue sheet, due to a rounded, smooth, textureless, bulging, "toothpaste" like area of the pattern 60. The bulge in the tissue sheet, due to the presence of the polymeric on the fabric 30, is raised above the rest of the tissue sheet. In this embodiment, the top 52 of the polymeric strand 45 and the top of the texture 31 are not co-planar.

Figure 10:
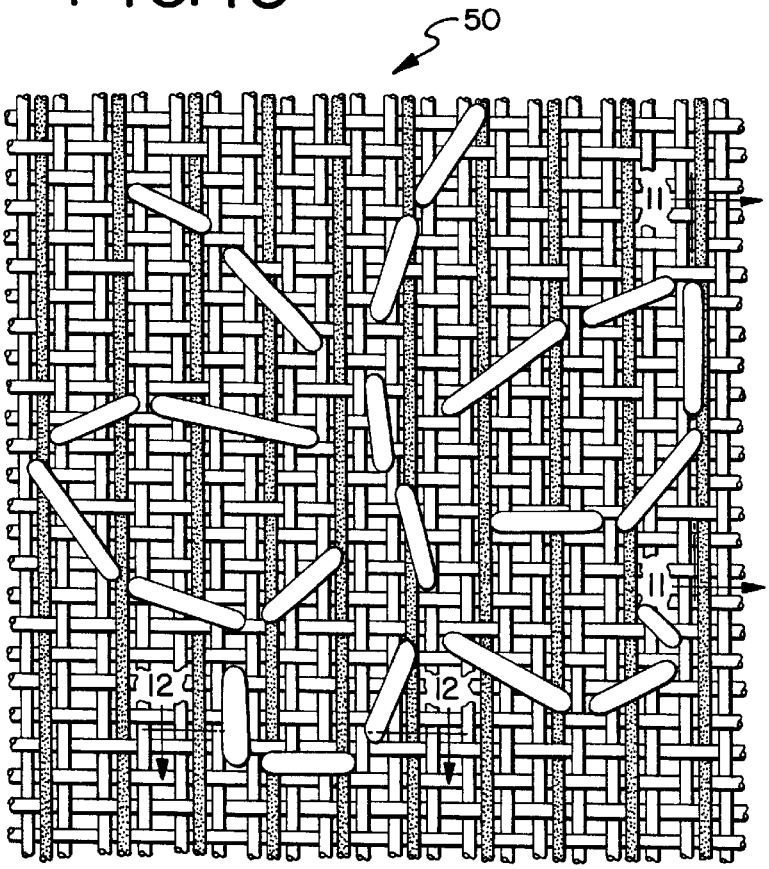
FIG. 10 is a planar view of a third embodiment of a through-air-drying fabric of the invention.
Figure 11:
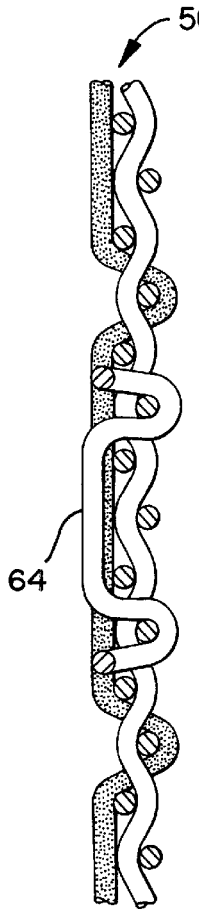
FIG. 11 is a cross-sectional view taken along line 11—11 of the through-air-drying fabric of the invention of FIG. 10.
Figure 12:
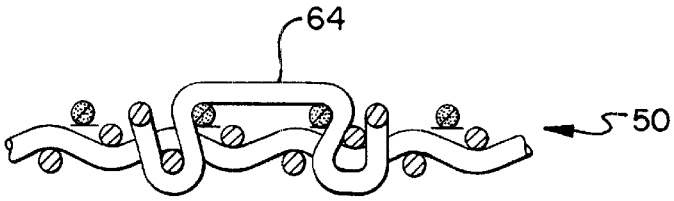
FIG. 12 is a cross-sectional view taken along line 12—12 of the through-air-drying fabric of the invention of FIG. 10.

In another embodiment, shown in FIGS. 10–12, a thread-like pattern is stitched into the textured TAD fabric 50 using a yarn 64. Where the yarn 64 is stitched into the textured TAD fabric 50 it will produce in the resulting tissue sheet an absence of texture corresponding to the stitched yarn 64 in the TAD fabric 50. The decorative thread-like pattern is composed of smooth line segments of differing length and orientation as compared to the background texture. The length and the orientation of the line segments are chosen for their aesthetic appeal. The background texture and the decorative thread-like pattern 70 may or may not be co-planar in the resulting tissue sheet.

Figure 13:
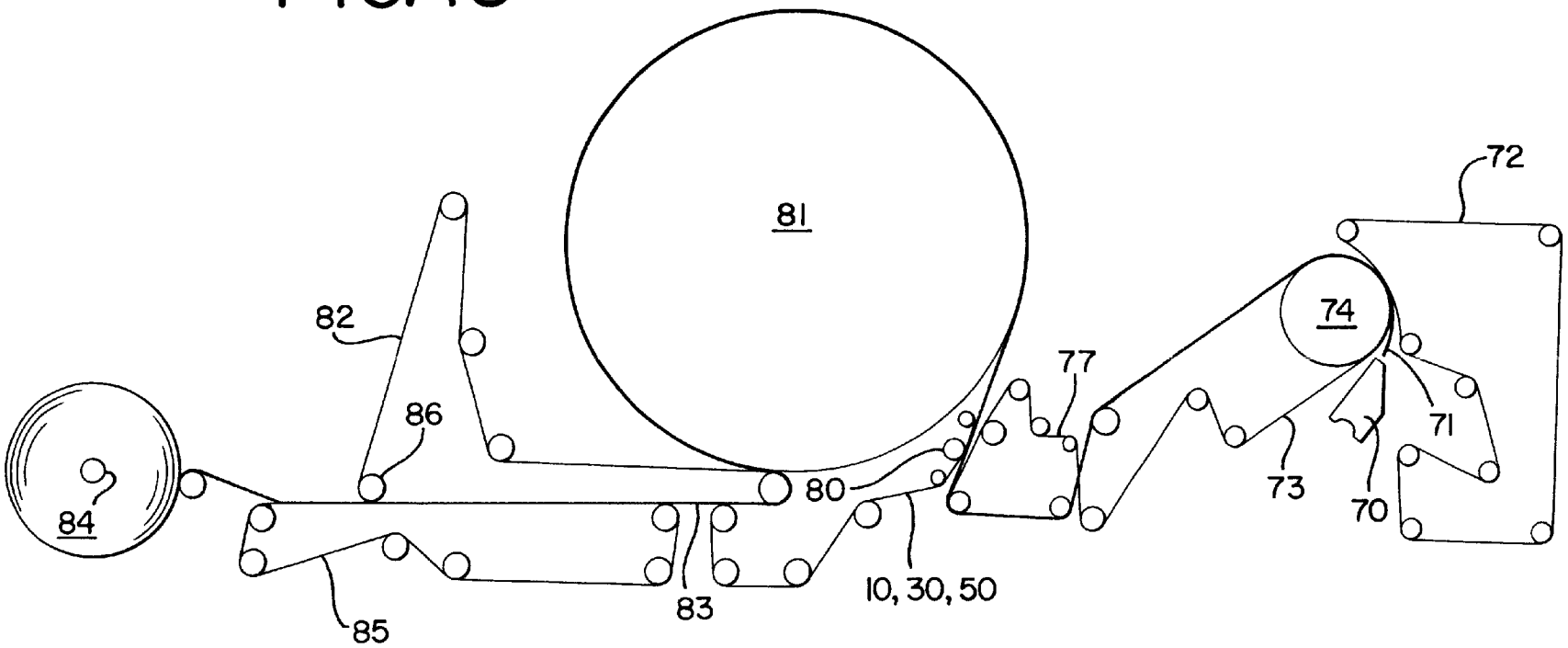
FIG. 13 is a schematic flow diagram for an embodiment of a method of making a tissue sheet in accordance with this invention.

An exemplary apparatus on which the TAD fabric 10, 30 or 50 may be used for making the tissue product having increased bulk and visual aesthetics is shown in FIG. 13 and described in U.S. Pat. No. 5,746,887 to Wendt et al., incorporated herein by reference. Generally, in the field of art, paper making fibers may also be known as a furnish. Further, the fine wire mesh 72, may also be known as a forming fabric. Initially, a stream 71 of an aqueous suspension of papermaking fibers is injected onto a fine wire mesh 72 where a substantial amount of water is removed from the furnish. The furnish is then transferred via transfer roll 74 to a forming fabric 73, which serves to support and carry the newly-formed wet web downstream. The web is then transferred from the forming fabric 73 to the transfer fabric 77.

Through the aid of a vacuum transfer roll or shoe 80, the wet-web is transferred to and molded onto a patterned TAD fabric 10, 30 or 50. While on the TAD fabric 10, 30 or 50, the wet-web is optionally carried across a vacuum box and further dewatered. In one embodiment, the wet-web is molded onto a TAD fabric 10, 30 or 50 which surrounds a drum through which hot air is passed. The passage of hot air through the web removes moisture and dries the web. During through-air drying, the web is re-strained, dried, and molded effectively inducing a three dimensional base sheet. The newly dried web conforms to the shape of the TAD fabric 10, 30 or 50.

In a further embodiment, the sheet is rush transferred between fabrics 73 and 77. In yet another embodiment, additional dewatering of the wet web can be carried out, such as by additional air vacuum suction, while the wet web is supported by the forming fabric 73. The web is finally dried to a consistency of about 94 percent or greater on the TAD fabric 10, 30 or 50 by the throughdryer 81.

After being dried on the throughdryer 81, the web is transferred to a carrier fabric 82. The dried basesheet 83 is transported to the reel 84 using carrier fabric 82. A further optional carrier fabric 85 may also be used in the transport. An optional pressurized turning roll 86 can be used to facilitate transfer of the web from the carrier fabric 82 to the optional fabric 85.

The present invention, utilizing the TAD fabric 10, 30 or 50 and process of the present invention avoids web compression, thereby preserving and enhancing the bulk of the web. If a Yankee dryer is used at all in the present process, it is primarily for creping the web rather than drying, since the web is substantially dry when it is transferred to the Yankee dryer surface. Transfer to a Yankee dryer does not significantly adversely affect web bulk because the papermaking bonds of the web have already been formed. Additionally, the web is much more resilient in the dry state. Furthermore, transfer to a Yankee dryer does not affect web bulk at least because the TAD fabric allows for a small area of intimate contact at the top of the knuckles with the tissue basesheet.

In contrast to the prior art, the presently developed throughdrying process avoids compression of the web in order to preserve and enhance bulk. However, in addition, the present invention involves drying the basesheet with a through-air-drying fabric having a background texture and a decorative pattern on it so that the background texture and decorative pattern becomes inherent in the sheet, providing aesthetic appeal for the end user.

The disclosure is provided as exemplary only and further embodiments commensurate with the spirit of the invention are envisioned. Therefore, it is to be limited only by the following claims which define the invention.

We claim:

1. A method of making a tissue product comprising:

depositing an aqueous papermaking furnish onto a top face of a forming fabric;

removing water from the furnish to form a web;

transferring the web to a top face of a through-air-drying fabric comprising a load-bearing layer defining a first plane and a sculpture layer interwoven with said load-bearing layer and defining a second plane spaced from said first plane, wherein said top face has a background texture defined by said load-bearing layer and said sculpture layer and wherein a polymeric strand is disposed on said top face in a decorative thread-like pattern, wherein said background texture is apparent where the pattern formed by the polymeric strand is absent, and wherein said web is in intimate contact with said top face and said polymeric strand; and through-air-drying the web to form a tissue sheet having a background texture and decorative pattern corresponding to the background texture and decorative pattern of said through-air-drying fabric.

2. The method of claim 1 further comprising creping said tissue sheet.

3. The method of claim 1 further comprising adhering said polymeric strand to said top face.

4. The method of claim 3 further comprising curing said polymeric strand after adhering said polymeric strand to said top face.

5. The method of claim 3 wherein said adhering said polymeric strand to said top face comprises extruding said polymeric strand onto said top face.

6. The method of claim 1 wherein said polymeric strand comprises a yarn and further comprising stitching said yarn to said through-air-drying fabric.

7. The method of claim 1 wherein a top surface of said polymeric strand is co-planar with a top surface of said top face.

8. The method of claim 1 wherein a top surface of said polymeric strand is raised above a top surface of said top face.

9. The method of claim 1 further comprising removing a portion of said polymeric strand from a top surface thereof.

10. The method of claim 9 wherein said removing said portion of said polymeric strand comprises sanding said top surface of said polymeric strand.

11. The method of claim 1 wherein said polymeric strand has a curved top surface.

12. A through-air-drying fabric used on a papermaking machine for molding a pattern onto a tissue sheet comprising:

a woven fabric comprising a load-bearing layer defining a first plane and a sculpture layer interwoven with said load-bearing layer and defining a second plane spaced from said first plane, wherein said woven fabric has a top face that is adapted to contact the tissue sheet, and wherein said top face has a background texture defined by said load-bearing layer and said sculpture layer; and a polymeric strand disposed on said top face in a decorative thread-like pattern wherein said background texture is apparent where the pattern formed by the polymeric strand is absent.

13. The through-air-drying fabric of claim 12 wherein a top surface of said polymeric strand is co-planar with a top surface of said top face.

14. The through-air-drying fabric of claim 12 wherein a top surface of said polymeric strand is raised above a top surface of said top face.

15. The through-air-drying fabric of claim 12 wherein said polymeric strand is adhered to said top face.

16. The through-air-drying fabric of claim 15 wherein said polymeric strand is extruded onto said top face.

17. The through-air-drying fabric of claim 12 wherein said polymeric strand comprises a yarn mechanically attached to the fabric.

18. The through-air-drying fabric of claim 17 wherein said yarn is stitched into said woven fabric.

19. The through-air-drying fabric of claim 12 wherein said polymeric strand has a circular cross-section.

20. The through-air-drying fabric of claim 12 wherein a top surface of said polymeric strand is substantially flat.

21. The through-air-drying fabric of claim 12 wherein said polymeric strand has a curved top surface.

* * * * *